US009016054B2

(12) United States Patent
Honsbein

(10) Patent No.: US 9,016,054 B2
(45) Date of Patent: Apr. 28, 2015

(54) DEVICE FOR COMPENSATING FOR HYDRAULIC EFFECTIVE PRESSURES

(75) Inventor: Rüdiger Honsbein, Lebach-Dörsdorf (DE)

(73) Assignee: Hydac System GmbH, Sulzbach/Saar (DE)

( * ) Notice: Subject to any disclaimer, the term of this patent is extended or adjusted under 35 U.S.C. 154(b) by 941 days.

(21) Appl. No.: 12/998,341

(22) PCT Filed: Oct. 16, 2009

(86) PCT No.: PCT/EP2009/007422

§ 371 (c)(1), (2), (4) Date: Apr. 11, 2011

(87) PCT Pub. No.: WO2010/051907

PCT Pub. Date: May 14, 2010

(65) Prior Publication Data

US 2011/0197573 A1 Aug. 18, 2011

(30) Foreign Application Priority Data

Nov. 7, 2008 (DE) ..... 10 2008 057 723

(51) Int. Cl.

| | |
|---|---|
| ***F16D 31/02*** | (2006.01) |
| ***F15B 1/02*** | (2006.01) |
| ***E02F 9/22*** | (2006.01) |

(52) U.S. Cl.

CPC ..... *F15B 1/021* (2013.01); *E02F 9/2207* (2013.01); *F15B 2211/625* (2013.01); *F15B 2211/8616* (2013.01)

(58) Field of Classification Search

CPC .... F15B 1/021; F15B 1/02; F15B 2211/8616; F15B 2211/625; F16L 55/04; F16L 2201/20–2201/22; E02F 9/2207

USPC ..... 60/413, 417, 469, 461

See application file for complete search history.

(56) References Cited

U.S. PATENT DOCUMENTS

| | | | | |
|---|---|---|---|---|
| 5,520,499 | A * | 5/1996 | Ufheil et al. | 414/685 |
| 6,938,413 | B2 * | 9/2005 | Harnischfeger | 60/413 |
| 6,966,329 | B2 * | 11/2005 | Liberfarb | 137/115.05 |
| 7,343,934 | B2 * | 3/2008 | Pride et al. | 137/625.64 |
| 2004/0088972 | A1 | 5/2004 | Harnischfeger et al. | |

FOREIGN PATENT DOCUMENTS

| | | |
|---|---|---|
| DE | 198 50 547 | 5/2000 |
| DE | 100 63 101 | 6/2002 |
| EP | 1 571 267 | 9/2005 |
| WO | WO 2004/070210 | 8/2004 |
| WO | WO 2008/088044 | 7/2008 |

* cited by examiner

*Primary Examiner* — Dwayne J White
*Assistant Examiner* — Logan Kraft
(74) *Attorney, Agent, or Firm* — Roylance, Abrams, Berdo and Goodman LLP

(57) ABSTRACT

A device for compensating for hydraulic effective pressures in a hydraulic accumulator (9) and a hydraulic actuator (5) of a hydraulic system (11, 13) has a valve arrangement (27) for blocking a connection between the hydraulic actuator (5) and hydraulic accumulator (9) and has a control valve device (11) performing a pressure compensation when a predetermined difference in effective pressures is exceeded.

11 Claims, 7 Drawing Sheets

DEVICE FOR COMPENSATING FOR HYDRAULIC EFFECTIVE PRESSURES

FIELD OF THE INVENTION

The invention relates to a device for compensating for hydraulic effective pressures in a hydraulic accumulator and a hydraulic actuator of a hydraulic system.

BACKGROUND OF THE INVENTION

In prior art hydraulic systems in which hydraulic actuators are used, for example, for support or lifting systems, hydraulic accumulators as spring or damper elements are hydraulically coupled to the actuator for cushioning or attenuating the movements of components moved by the hydraulic actuator. In some operating situations of such systems, however, an uncushioned, rigid dynamic connection between the actuator and the device actuated thereby is necessary, for example, for a hydraulically actuated boom intended to form a rigid support element, or for a tool to be controlled vibration-free when in use. In view of these requirements, the connection between the pertinent actuator and the hydraulic accumulator must be blocked.

In operation with the spring system blocked, the effective pressure in the hydraulic actuator changes according to the performance to be delivered by it. If at this point the system is transferred from the state of the blocked spring system back into the state with the hydraulic accumulator connected, a difference in the effective pressure between the hydraulic accumulator and the actuator leads to uncontrolled motion at the actuator. This uncontrolled motion poses a hazard to the system and a safety risk for system operators.

SUMMARY OF THE INVENTION

An object of the invention is to provide a device that prevents this safety risk from uncontrolled motion.

This object is basically achieved according to the invention by a pressure compensation device having a valve arrangement that blocks the connection between the hydraulic actuator and the hydraulic accumulator. The valve arrangement has an additional control valve that affects pressure compensation when a predetermined difference of the effective pressures is exceeded. This pressure compensation avoids the risk of uncontrolled motion when the system is transferred from the state of the blocked spring system into the state with the spring system released, because the respective effective pressures of the hydraulic accumulator and of the hydraulic actuator are matched to one another.

If, in the state of the blocked spring system, the pressure that is effective in the hydraulic accumulator is less than the effective pressure in the respective working situation in the hydraulic actuator, pressure compensation can easily take place in the conventional manner by the hydraulic actuator charging the hydraulic accumulator via a non-return valve up to a constant pressure. The non-return valve closes when the pressure is equal.

The particular advantage of the invention is that, when a higher pressure prevails in the hydraulic accumulator, this pressure is reduced by pressure drainage toward the tank side of the hydraulic system.

The valve arrangement can have a directional valve that, in its release state, establishes a direct fluid connection between the hydraulic actuator and the hydraulic accumulator and interrupts this fluid connection in its blocked state. The control valve can be activated depending on the transfer of the directional valve into the blocked state and can contain a drainage valve controllable by a difference of effective pressures that exceeds the preset value into the drainage valve release state in which a drainage path that reduces the pressure difference toward the tank side of the hydraulic system is formed. This arrangement ensures that the equalization of the effective pressures takes place not only by charging of the hydraulic accumulator, but that charging of the hydraulic accumulator can take place only up to a pressure level at which the prescribed pressure difference is not exceeded, because, when this pressure difference is reached, pressure compensation takes place via the drainage valve toward the tank side of the system.

The hydraulic actuator can have at least one lifting cylinder of a machine with a piston side producing the lifting force and with a rod side connected to a control block of the machine. The piston side of the lifting cylinder is connectable via the directional valve to the hydraulic accumulator. The control valve has a connection to the hydraulic accumulator and fluid paths to the piston side and to the rod side of the lifting cylinder. Two fluid paths contain non-return valves that clear the fluid path only to the side of the lifting cylinder carrying the higher effective pressure.

A drainage valve can be in the form of a pressure compensator. In the release state, the pressure compensator clears the drainage path toward the tank side from the connection to the hydraulic accumulator and from the fluid path cleared in each case and leading to the lifting cylinder.

To avoid generating noise or causing damage to the hydraulic accumulator, the drainage process can take place from the accumulator to the tank side only when the pressure difference is somewhat greater than zero. At the same time, preloading that intensifies the action of the closing pressure can be active on the pressure compensator.

The pressure compensator can have a slide valve piston that, for its displacement into the blocking position on one piston area, can be loaded both with the closing pressure from the hydraulic working circuit and loaded with the force of a preload spring.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
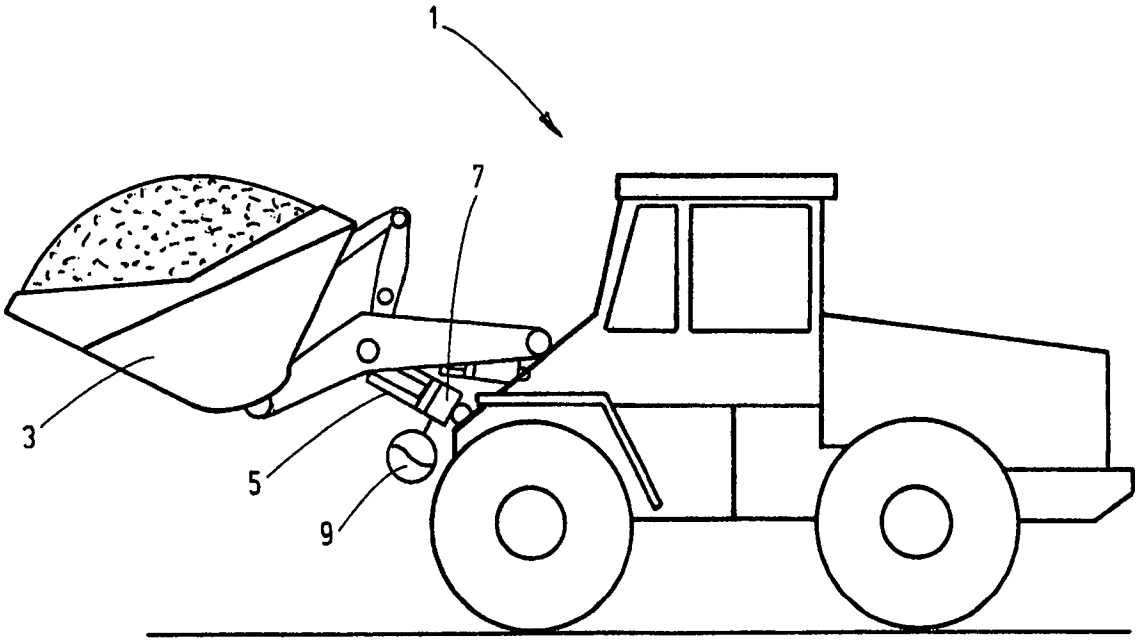
FIG. 1 is a schematically simplified, side elevational view of a mobile machine in the form of a wheel loader, equipped with one exemplary embodiment of the device according to the invention.

FIG. 1 shows a mobile machine in the form of a wheel loader 1 with a shovel 3 coupled to a lifting cylinder 5. The cylinder 5 forms the hydraulic actuator of the exemplary embodiment of the device according to the invention to be described. The piston side 7 of the lifting cylinder 5 produces the lifting force for the shovel 3 when pressure is supplied and is connected to a hydraulic accumulator 9, indicated only symbolically in FIG. 1, via the hydraulic components not illustrated in FIG. 1.

Figure 2:
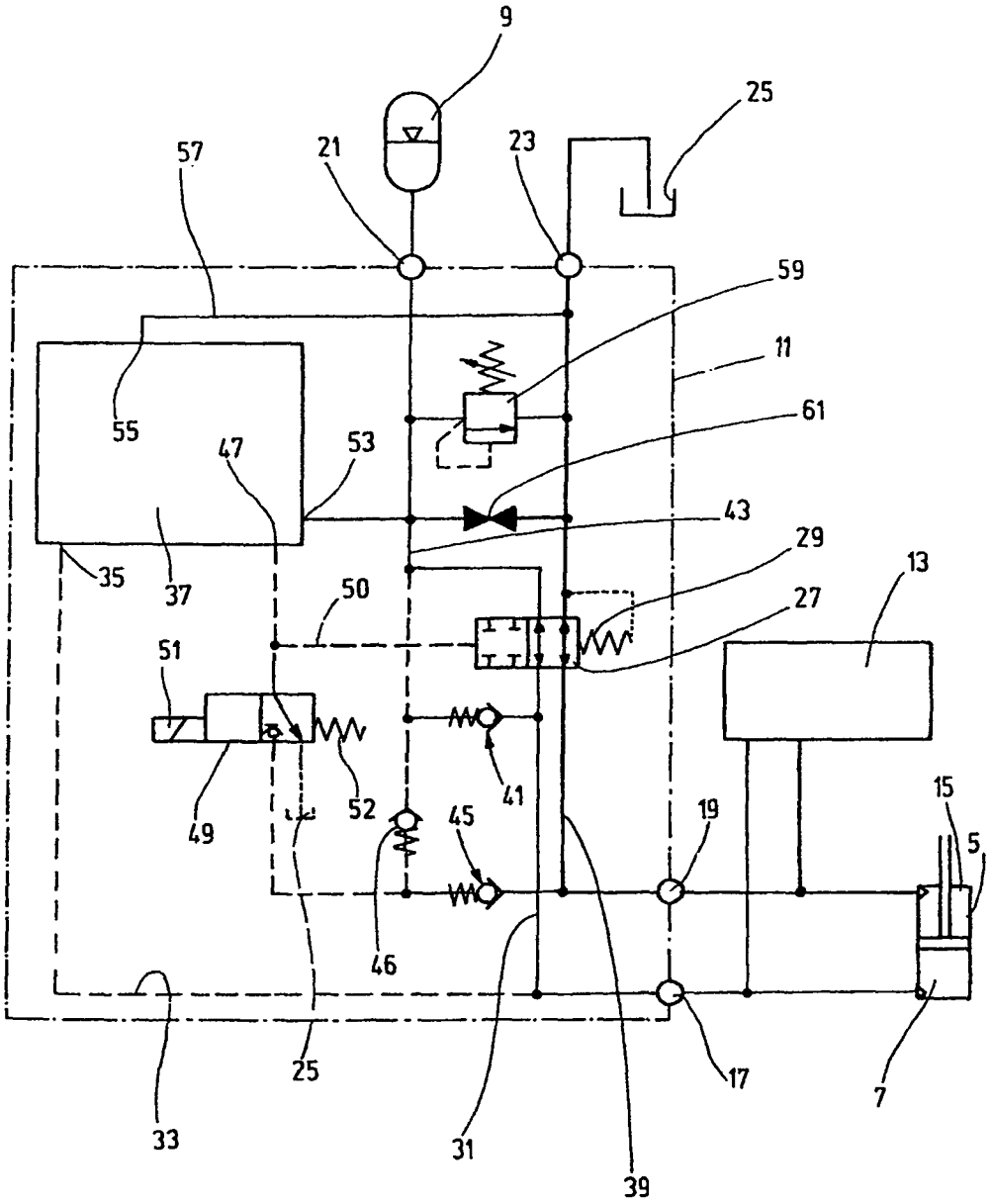
FIG. 2 is a symbolic circuit diagram of the hydraulic system of the exemplary embodiment of the device according to the invention, shown in the operating state with the spring system released.

FIGS. 2 to 5 in a symbolic representation show the circuit of the hydraulic system in different operating states. FIG. 2 shows the state with the spring system released. A control block 13 of the machine (wheel loader 1) with a pressure supply (not shown), for controlled supply of the lifting cylinder 5 is connected to its piston side 7 and its rod side 15. A valve arrangement 11 that forms the principal part of the hydraulic system has inputs or ports 17 and 19 connected to the piston side 7 and the rod side 15 of the lifting cylinder 5, respectively. The hydraulic accumulator 9 and the tank 25 of the hydraulic system are connected to the outputs 21 and 23, respectively, of the valve arrangement 11.

As mentioned, FIG. 2 shows the state of the released spring system. A directional valve 27 is in its release state as a result of its mechanical spring preload or spring 29. The piston side 7 on the input or port 17 is connected directly to the hydraulic accumulator 9 at the output 21, and the rod side 15 of the lifting cylinder 5 is connected via the input 19 directly to the tank 25 at the output 23. In this operating state, the other hydraulic components are not involved in the operating process; i.e., the system effects a conventional cushioning/damping of the activity of the lifting cylinder 5.

As mentioned, in certain operating situations a spring system is not useful or is detrimental. When a shovel 3 of a loader 1 is actuated, for example, spring compression or rebound has a negative effect on the accuracy of the positioning of the shovel 3. The system is transferred into the state of the blocked spring system such that, by supplying a hydraulic control pressure via a control line 50, the directional valve 27 is moved into the blocking state against the preload 29, as detailed below.

Figure 3:
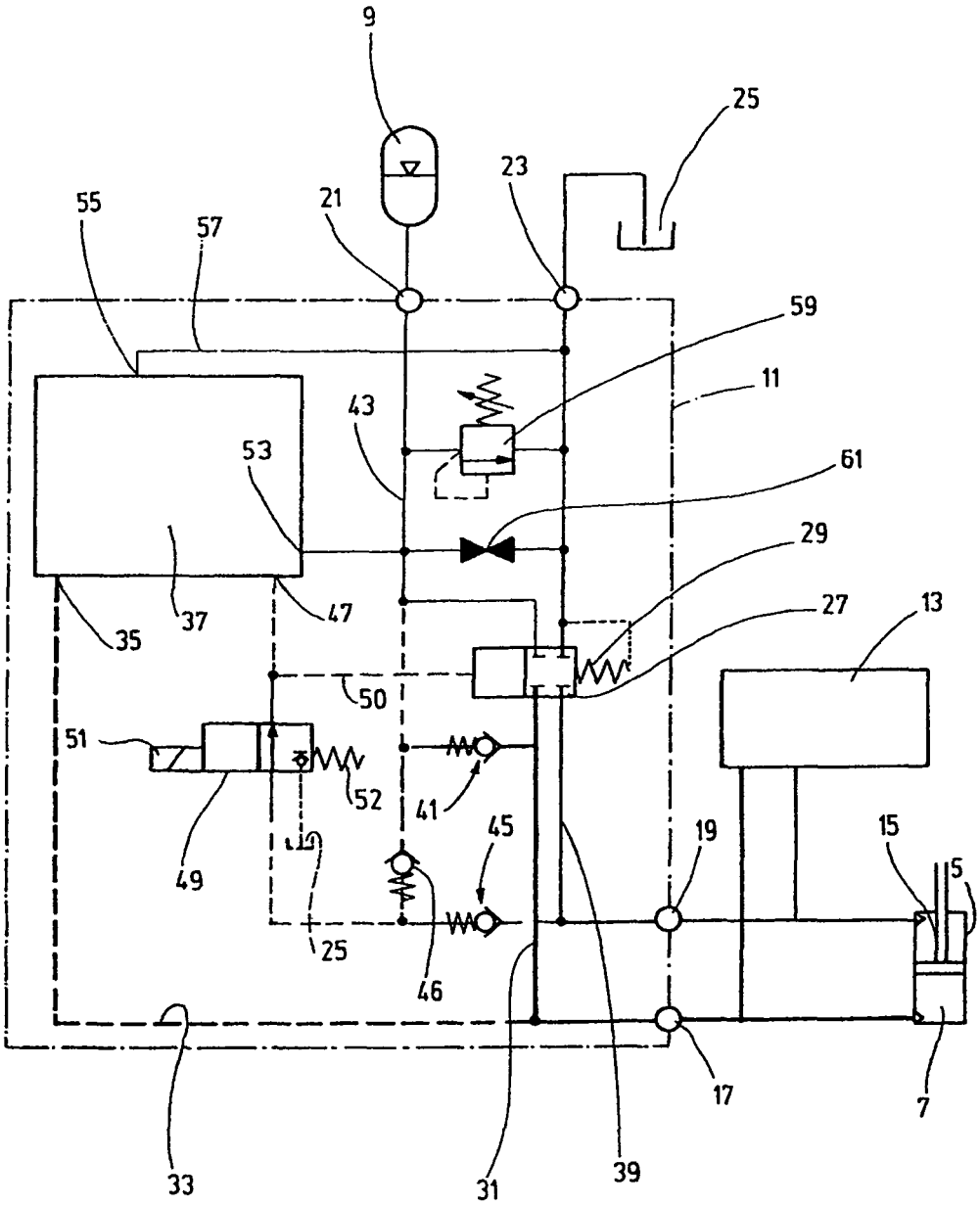
FIG. 3 is a circuit diagram of the device of FIG. 2, with the operating state being shown with an effective pressure in the hydraulic accumulator that is smaller than the effective pressure on the piston side of the lifting cylinder.
Figure 4:
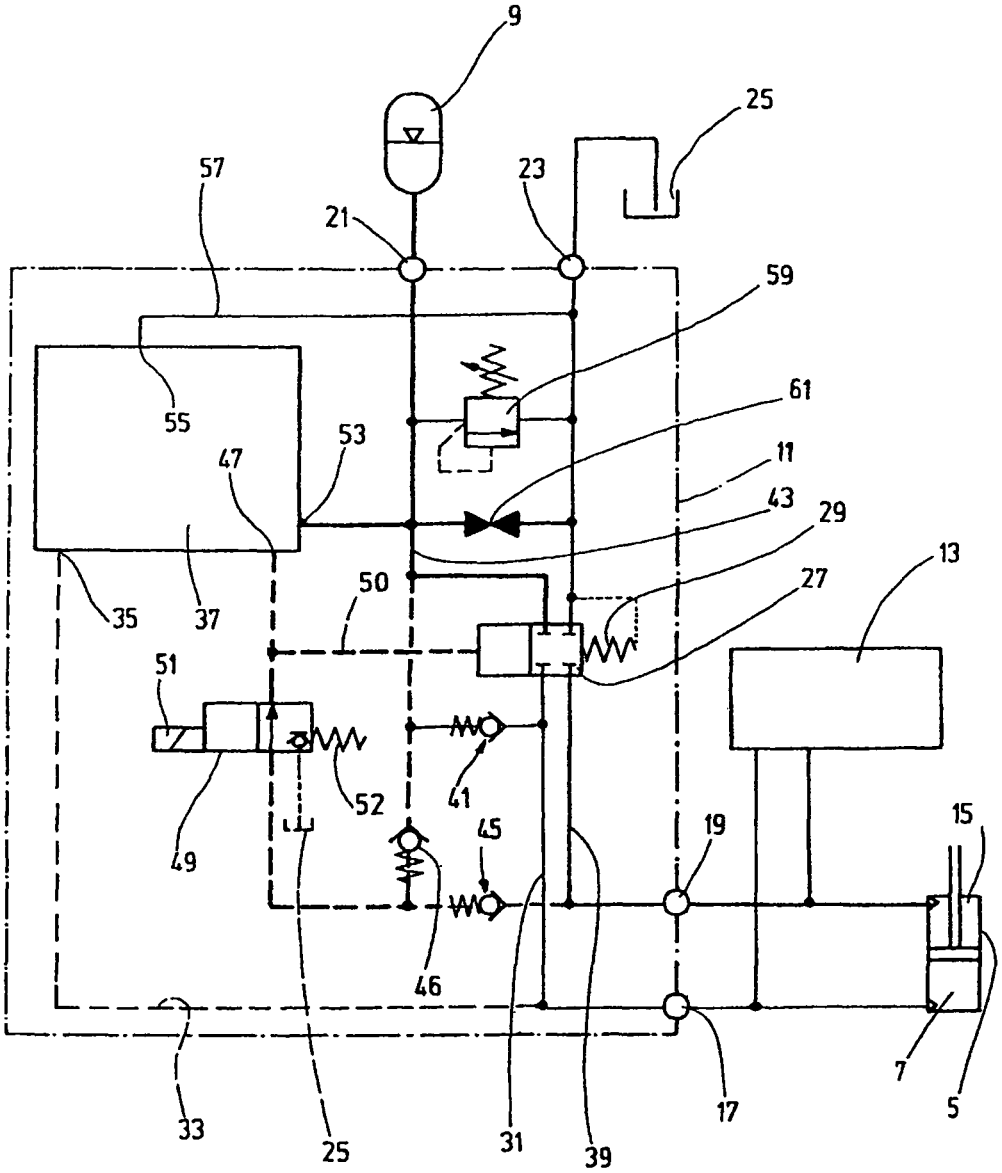
FIG. 4 is a circuit diagram of the device of FIG. 2, with the effective pressure in the accumulator being greater than on the piston side of the lifting cylinder.
Figure 5:
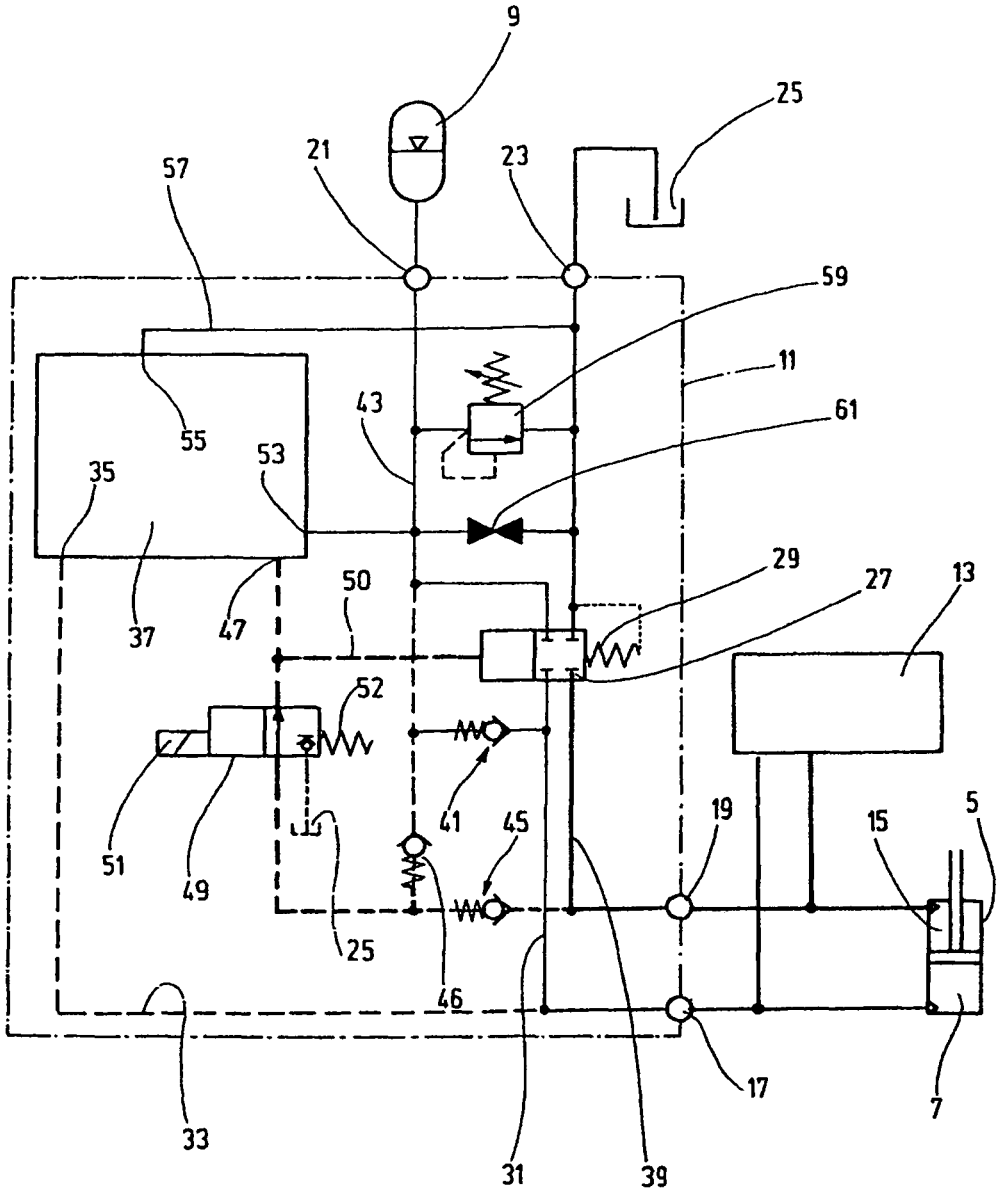
FIG. 5 is a circuit diagram of the device of FIG. 2 with the effective pressure on the rod side of the lifting cylinder being greater than on the piston side or in the hydraulic accumulator.

FIGS. 3 to 5 illustrate three different operating modes for the spring system blocked in each case. In FIG. 3 state, the piston side 7 of the lifting cylinder 5 is at a higher effective pressure than in the hydraulic accumulator 9, as dictated by operation. Accordingly. FIG. 3 shows with the thicker line the fluid connections that carry the higher pressure, specifically from the input 17 of the valve arrangement 11 to the blocked directional valve 27 via a line branch 31 and from the line branch 31 via a closing pressure control line 33 shown by the thick line to a control port 35 of a drainage valve 37. This control port 35 is designated as the second control port. Corresponding to the effective pressure that prevails in the line branch 31 and that is higher than that in the line branch 39 indicated by the thin line at the input 19 and on the rod side 15 of the lifting cylinder 5, a non-return valve 41 connected to the line branch 31 is opened so that the accumulator 9 at the output 21 is charged to the pressure of the piston side 7 via an accumulator line 43. In this state, the non-return valve 45, connected between the accumulator line 43 and input 19 in the same direction as non-return valve 41, is closed. This arrangement of the non-return valves 41 and 45 causes the higher effective pressure from the inputs 17 and 19 to take effect in the system via a respective fluid path formed by opening of one or another non-return valve. Furthermore, in the connecting line to the accumulator 9 between the two port sites of the non-return valves 41 and 45 another non-return valve 46 is connected that, oriented toward the accumulator 9, moves into its pertinent closed position.

Another control port 47 of the drainage valve 37, referred to as the first control port, is connected via a control valve 49, when it is in its opening state shown in FIG. 3, to the accumulator line 43 which in turn is connected to the input 17 or the input 19 corresponding to one or another fluid path, i.e., depending on which of the non-return valves 41 or 45 is opened. In the state shown in FIG. 3, the fluid path leads via the non-return valve 41 to the input 17 that carries the higher effective pressure. The pressure that prevails on the first control port 47 via the opened control valve 49 also serves as a hydraulic control pressure that hydraulically transfers the directional valve 27, which directional control valve 27 is preloaded into the opening state by its spring preload 29, into the closed state shown in FIG. 3, and thus, moves the entire system into the state of the blocked spring system.

With the released spring system in the state of FIG. 2, the control valve 49 is in its closed state caused by its actuating magnet 51 being energized so that the valve 49 is closed against its opening spring 52. In this way, in the state of the released spring system, the first control port 47 of the drainage valve 37 and the control line 50 of the directional valve 27 are depressurized by connecting to the tank side 25. The preload 29 therefore keeps the directional valve 27 in its opening state. If the power to the actuating magnet 51 is interrupted and the control valve 49 is opened, the directional valve 27 is hydraulically directed against its preload 29 into the blocked state via the control line 50, and the system passes into the state of the blocked spring system, as is shown in FIGS. 3 to 5.

In the state shown in FIG. 3, in which the higher effective pressure prevailing in the line branch 31 charges the hydraulic accumulator 9 via the non-return valve 41 and the accumulator line 43, on the first control port 47 and on the second control port 35 of the drainage valve 37 the same pressures prevail in each case, specifically via the control line 33 from the input 17 and via the opened non-return valve 41 and the opened control valve 49 likewise from the input 17. The drainage valve 37 is a pressure compensator that is in the closed state when this constant pressure prevails on the control ports 47 and 35. The drainage valve 47 in this closed state does not form a drainage path from the input port 53 to an output port 55 that leads via a drain line 57 by way of the output 23 to the tank 25. Therefore, no drainage process takes place from the accumulator line 43 connected to the output 23 and the tank 25 via a pressure limitation valve 59 that forms an overpressure safeguard. A drainage valve 61 is likewise connected to the accumulator line 43 and that is manually opened only for maintenance purposes.

FIG. 4 conversely shows a state in which, likewise with the spring system blocked, the effective pressure in the hydraulic accumulator 9 is higher than the system pressure that is effective as dictated by operation on the piston side 7 of the lifting cylinder 5, and thus, via the input 17 in the valve arrangement 11. To illustrate this in FIG. 4, in the part uppermost in the figure, the accumulator line 43 is indicated by the thick solid line and in its lower line part by the thick broken line. The non-return valve 41 is closed corresponding to the effective pressure that prevails in the hydraulic accumulator 9, which effective pressure is higher than in the lifting cylinder 5.

The higher effective pressure of the hydraulic accumulator 9 is on the first control port 47 of the drainage valve 37 via the control valve 49 that is opened by the spring preload 52 and that is not energized. The second control port 35 carries the lower effective pressure of the input 17 via the line branch 31.

Figure 6:
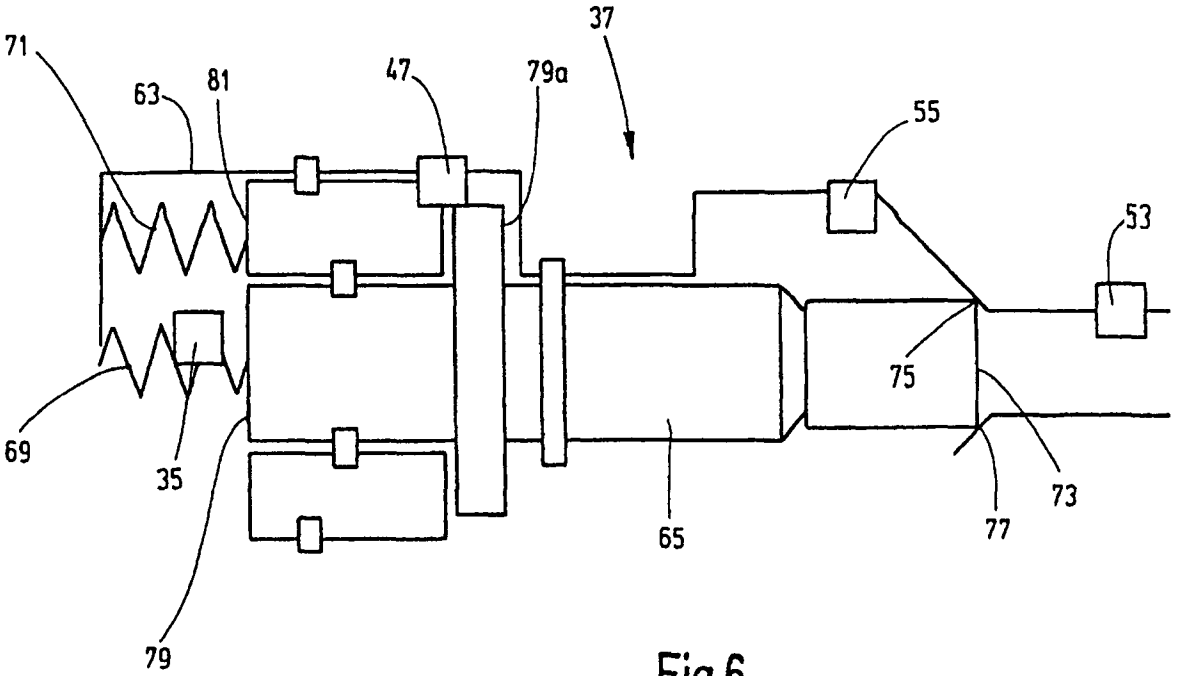
FIG. 6 is a functional and schematic side elevational view of a pressure compensator that serves as a drainage valve of the exemplary embodiment of FIG. 2.
Figure 7:
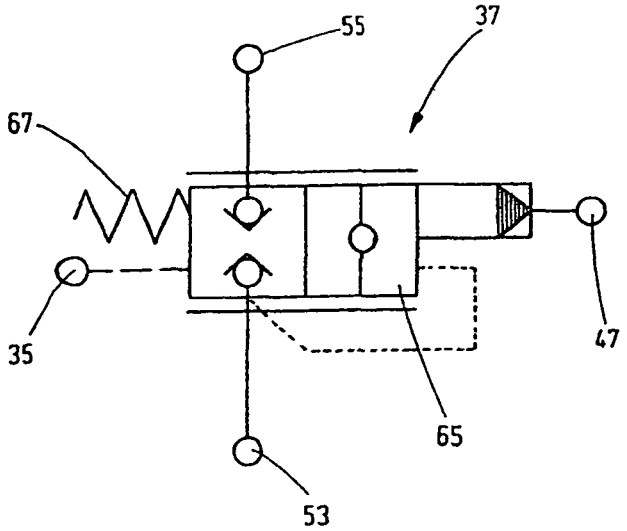
FIG. 7 is a symbolic representation of the pressure compensator of FIG. 6.
Figure 8:
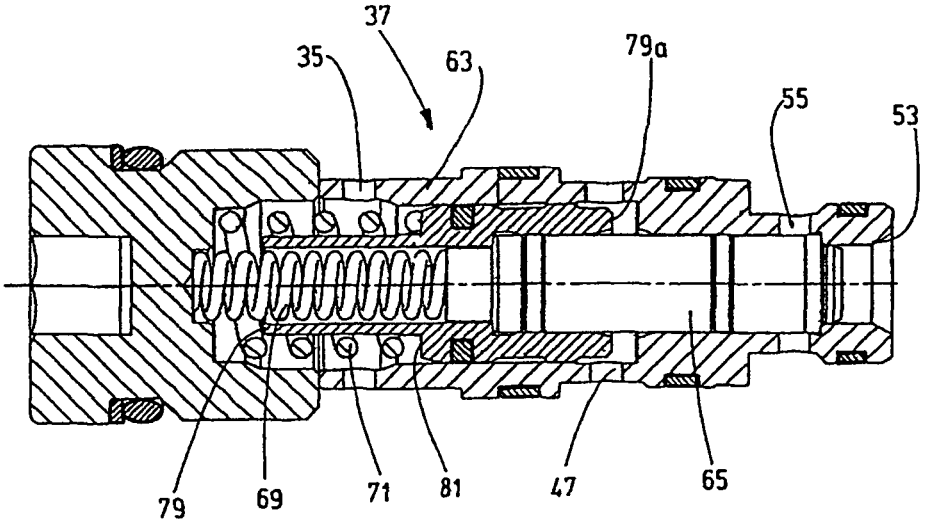
FIG. 8 is a side elevational view in section of a spool valve that serves as a pressure compensator of FIG. 6 and that can be inserted into a valve block (not shown).

As already mentioned, the drainage valve 37 has a pressure compensator shown symbolically in FIG. 7 and in the form of an operating diagram in FIG. 6. FIG. 8 shows a longitudinal section of one practical embodiment. Drainage valve 37 is a spool valve with slide valve piston 65 axially displaceable in the valve housing 63, shown in the closed position. This closing is caused by a hydraulic closing pressure that acts on the second control port 35, amplified by a mechanical preload force 67 in FIGS. 6 and 7. The drainage valve 37 opens by a hydraulic opening pressure that is active on the first control port 47, assuming that the opening pressure on the slide valve piston 65 causes a higher opening pressure than the closing pressure that prevails on the control port 35, amplified by the preload force 67. In other words, the condition for the drainage valve 37 to open to form a drainage path from the input port 53 to the output port 55 and thus to the tank 25 is when the closing forces acting on the slide valve piston 65 resulting from the pressure on the second control port 35, plus the mechanical preload 67, is smaller than the opening pressure produced by the hydraulic pressure on the first control port 47. Therefore $$F_{preload}+F_{pressure35}<F_{pressure47}$$

In the state depicted in FIG. 4, the pressure from the hydraulic accumulator 9 is drained until only a given, desired low pressure excess between the accumulator 9 and thus the input port 53 remains relative to the control port 35, i.e., the lifting cylinder 5, corresponding to the design of the pressure compensator that forms the drainage valve 37, specifically the effective piston areas and the effective preload force 67. This state means that a drain process cannot lead to reducing the pressure in the hydraulic accumulator 9 to a value of zero.

Advantageously, the opening pressure difference dictated by the piston geometry and the preload force 67 can be a pressure level of approximately 8 bar. FIG. 8 shows two helical springs 69 and 71 acting on a two-part slide valve piston 65 for producing the preload force 67 and preloading the piston 65 into the illustrated closing position to the right in the figure, in which the input port 53 located on the axial end of the spool housing 53 on the right side in the figure is blocked relative to the output port 55. In addition to the preload force 67, the hydraulic pressure from the second control port 35 acts on the side of the piston 65, which side is the left one in the figure. As the opening pressure for moving the piston 65 in the figure to the left, the right piston area is subjected to the opening pressure via the first control port 47.

To ensure that the pressure present on the input port 53 does not take effect as the effective control pressure that determines the behavior of the pressure compensator, the piston area 73 indicated in FIG. 6 and bordered by the control edges 75 and 77 between the ports 53 and 55 importantly be considerably smaller than the effective piston areas 79, 79*a*, and 81 on the pressure spaces on the control port 47 or control port 35.

FIG. 5 relates to another state in which, at the input 19 of the valve arrangement 11, the higher effective pressure prevails, compared to the pressure at the input 17 or the pressure in the hydraulic accumulator 9. This operating state arises when a device runs up against an obstacle during operation of a machine with the spring system blocked. This state can be the case, for example, when a mobile device, such as a wheel loader 1, with its shovel 3 runs up against an obstacle that forms an elevation. As a result of this situation, the weight of the wheel loader 1 resting on the shovel 3 pushes the piston of the pertinent lifting cylinder 5 into the rod side 15, causing an overpressure to form on the rod side 15. This overpressure takes effect via the input 19, with the non-return valve 45 opening in this state, as well as via the opened control valve 49 on the first control port 47 of the drainage valve 37. When the opening condition is met, i.e., a higher pressure on the port 53 compared to the control port 35 connected to the input 17 via the line branch 31, the drainage valve 37 then opens. As a result of valve 37 opening, in turn the drainage path to the tank 25 is opened, causing the pressure of the accumulator line 43 to be relieved. The higher pressure in the control port 47 ensures that the valve 37 is not in the blocking position.

As FIGS. 6 and 8 show in particular, the actual pressure compensator is formed by the helical spring 69 and by the effective pressure surfaces of the axially displaceable slide valve piston 65. The blocking piston made as a valve spool is in turn formed by the helical spring 71 and the effective piston area 81 of the indicated blocking piston part.

The piston 65 in FIG. 6 can be made in several parts to form a non-return valve, i.e., the multipart design prevents opening of the valve seat 55 and unwanted backflow of the fluid into the system when a pressure prevails on the port 55 that is higher than that pressure formed by the preload forces of the helical springs 69 and 71 plus the effective compressive force by the pressure on the second control port 35. If this non-return valve function is to be omitted, the illustrated slide valve piston arrangement can also be made in one piece (not shown).

The invention thus ensures that the safety function is pressure compensation for all operating modes. The construction of the drainage valve 37 as shown in FIGS. 6 and 8 is not mandatory. Any valve construction whose operation corresponds to the aforementioned opening and closing conditions can be used. The construction of the two-part slide valve piston 65 depicted in FIG. 8 and the construction of the piston part to the right in this figure at the input port 53 forming a non-return valve loaded by the spring 69 with low closing force are not mandatory. In this construction, the closing spring 71 forms the principal part of the preload 67 in FIGS. 6 and 7 and amplifies the closing force of the valve.

What is claimed is:

1. A device compensating hydraulic effective pressures in a hydraulic accumulator and a hydraulic actuator of a hydraulic system with at least one lifting cylinder, comprising:

a directional valve being movable between a blocked state thereof interrupting a fluid connection between a hydraulic actuator and a hydraulic accumulator and a release state thereof providing a direct fluid connection between said hydraulic actuator and said hydraulic accumulator for pressure compensation when a pre-determined value of a difference of effective pressures is exceeded;

a control valve arrangement having an accumulator line leading from said directional valve to said hydraulic accumulator, having a first line branch leading from a piston side of a lifting cylinder to said directional valve and having a second line branch leading from a rod side of said lifting cylinder to said directional valve;

a drainage valve of said control valve arrangement being blockable by the difference of effective pressures exceeding the pre-determined value to a release state thereof in which a drainage path reduces the pressure difference to a tank side of a hydraulic system; and a fluid path to said accumulator line bypassing said directional valve in blocked states of said first and second line branches, said fluid path having a non-return valves therein directed toward said piston side such that pressure from said piston side can be cleared via said fluid path by opening the non-return valve by an effective pressure exceeding pressure in the hydraulic accumulator and via said accumulator line to said hydraulic accumulator.

2. A device according to claim 1 wherein said lifting cylinder is on a machine, with said piston side producing a lifting force and with said piston side and said rod side being connected to a control block of said machine.

3. A device according to claim 1 wherein said drainage valve comprises a pressure compensator that clears said drainage path leading to said tank side from said accumulator line to said hydraulic accumulator and from said fluid path leading to said lifting cylinder that has been cleared in a release state thereof.

4. A device according to claim 3 wherein said pressure compensator comprises an input port connected to said hydraulic accumulator, an output part connected to said tank side, a first control port for supplying unblocked pressure and a second control port for supplying closing pressure.

5. A device according to claim 4 wherein said second control port is connected to said piston side in fluid communication.

6. A device according to claim 4, wherein a preload amplifies action of said closing pressure supplied to said second control port on said pressure compensator.

7. A device according to claim 4 wherein said pressure compensator comprises a slide valve piston displaceable into a blocking position on one piston area loadable with the closing pressure prevailing on said second control port and with a force of a preload spring, and comprises another piston area loadable with the unblocking pressure prevailing on said first control port.

8. A device according to claim 7 wherein said slide valve piston comprises an effective piston area bordering said second control port and being greater than an effective piston area bordering said first control port.

9. A device according to claim 7 wherein said input port of said pressure compensator is on an end of said slide valve piston opposite said preload spring and is formed by an axial end-side opening of a spool housing; and a control edge is on each of an end region of said slide valve piston and said spool housing between said end-side opening and said first control port, said first control port being offset axially to an inside of said spool housing.

10. A device according to claim 4 wherein a control valve in an opening state thereof connects said fluid path conveying the higher effective pressure to said first control port of said pressure compensator and delivering hydraulic pressure to said directional valve for movement to the blocked state thereof.

11. A device according to claim 1 wherein said directional control valve is mechanically preloaded into the release state thereof and is hydraulically movable into the blocked state thereof.

* * * * *